United States Patent [19]

Weinert et al.

[11] Patent Number: 4,742,765

[45] Date of Patent: May 10, 1988

[54] POWER ROOF VENTILATOR

[75] Inventors: Bernd Weinert, Ohringen; Heinz Wieland, Waldenburg, both of Fed. Rep. of Germany

[73] Assignee: Wilhelm Gebhardt GmbH, Waldenburg, Fed. Rep. of Germany

[21] Appl. No.: 942,528

[22] Filed: Dec. 16, 1986

[30] Foreign Application Priority Data

Dec. 21, 1985 [DE] Fed. Rep. of Germany ..... 3545684
Dec. 24, 1985 [DE] Fed. Rep. of Germany ..... 3546083

[51] Int. Cl.[4] ..... F24F 7/02

[52] U.S. Cl. ..... 98/42.02; 98/42.06; 98/42.11

[58] Field of Search ..... 98/42.02, 42.06, 42.11; 110/162

[56] References Cited

U.S. PATENT DOCUMENTS 2,551,004 5/1951 Johnson ..... 98/42.02
2,711,682 6/1955 Drechsel ..... 98/42.11
3,946,648 3/1976 Schneider ..... 98/42.02
3,960,063 6/1976 Siemes et al. ..... 98/42.11

FOREIGN PATENT DOCUMENTS

P3438710 4/1986 Fed. Rep. of Germany .

*Primary Examiner*—Larry I. Schwartz
*Attorney, Agent, or Firm*—Steven L. Permut; Malcolm L. Sutherland

[57] ABSTRACT

The invention relates to a motor-powered roof ventilator or extractor fan having its motor-impellor unit mounted within the housing for mounting on the roof or wall of a building. The centrifugal impellor draws in air through a base member adapted for attachment to the roof by way of an intermediate mount and expels it through oblique, diverging outlet ports away from the roof. The outlet ports are constituted by the ends of channel-like, mutually opposite side parts of the housing which are hinged to the base member and may be folded away from the rest of the housing to uncover the centrifugal impellor and the motor for inspection and servicing.

15 Claims, 3 Drawing Sheets

POWER ROOF VENTILATOR

BACKGROUND OF THE INVENTION

The invention relates to power roof ventilators and more particularly to a ventilator of the type comprising a centrifugal impellor driven by a motor about a vertical axis, and a housing encompassing the centrifugal impellor and the drive motor. The housing is so designed that it may be connected by means of hollow mount with the roof or a wall of a building premises to be power ventilated. The ventilator is so configured that at least in a part adjacent to a flat base member representing the connection with the mount, it has the outline of a rectangel or square and has an inlet port on a side adjacent to the mount and a radial outlet section with two outlet ports on opposite sides of the housing so that the air current is conducted away from the vicinity of the drive motor.

Such a roof ventilator has been proposed in the German patent application P No. 3,438,710, in which air is drawn in from a rood to be ventilated by a centrifugal impellor in which it moves axially before leaving it in a generally radial direction and passes through outlet ports. Since there are only two, opposite outlet ports, the air is swept away in a substantially sin-free, aligned flow clear of the ventilator and travels some distance clear of the ventilator in operation. This type of roof ventilator is furthermore characterized by a low power dissipation and by quiet running. However, experience has shown that inspection and servicing of such a roof ventilator is relatively involved and that the centrifugal impellor and the motor are not readily accessible from the outside for inspection.

SUMMARY OF THE INVENTION

Accordingly one object of the present invention is to so improve a roof ventilator of the initially defined construction, without sacrificing any of its useful features, that inspection and servicing of the ventilator generally and of its centrifugal impellor and drive motor in particular, may be undertaken simply and quickly.

A further object of the invention is to produce a ventilator attaining this object which has a simple structure and a low production price.

In order to achieve these or other objects of the invention appearing from the present specification and claims, a roof ventilator is characterized by comprising a centrifugal impellor and a driving motor therefor constituting a motor-impellor unit, a housing containing said unit, a plate-like, flat base member joined to said housing, said housing being rectangular at least where it is joined to said base member, said housing having an air inlet port at said base member and being adapted to discharge air in a radial direction with respect to said motor away from said ventilator from two opposite sides thereof, and said housing furthermore including readily opening side sections at two said opposite sides, said side sections being able to be moved between a closed operational position of the ventilator and an open position in which they expose said motor-impellor unit.

Another aspect of the invention provides a ventilator whose housing is able to be opened on two of its end walls having the outlet ports constructed in such a way that the centrifugal impellor and/or its drive motor (which are covered over in the operational condition of the ventilator) may be seen after the opening of the housing end walls to the inspection mode and are accessible since the two housing end walls, which are associated with the opposite rectangular housing walls may be respectively partly or completely dismounted from the housing or may be folded clear of the rest of the base of the housing as such or with a further wall part.

There is therefore the advantage that the roof ventilator does not have to be removed from the base for inspection or servicing and all that is required is for two opposite sides of the housing to be opened so that the user has easy access to the interior of the ventilator and he is furthermore instantly able to check the condition of the impellor, the amount of dirt deposited thereon, the direction of rotation and other features without the ventilator having to be put out of operation for prolonged periods of time. Even major repair or servicing operations on the ventilator are made possible by a simple locking and unlocking mechanism on the ventilator housing. In certain cases the check may be carried out while the ventilator is still running. The invention provides for the external form of prior art ventilators so that when an architect plans shape a building he will not need to take any change in form of the ventilator into account. The housing of the ventilator is able to be produced simply and at low costs owing to the elementary geometry of the individual components. This furthermore makes possible the arrangment of the door-like (i.e. opening) side walls so as to have the outlet ports and so that a group of ventilators may be placed adjacent to each other without impairing access to their interiors.

Another aspect of the invention provides housing side sections in the form of removable inspection doors that are detachably fitted to the ventilator in its operable condition with sealing means therebetween, more particularly in the form of strip seals extending between the removable doors and the parts of the walls which are not moved with the doors of the housing.

This form of the invention ensures an optimum sealing system even though walls of the ventilator are designed as removable or hinged doors so that no spurious air will be drawn in and the spent air will only be expelled through the air outlet ports when the ventilator is running. It is furthermore possible for part of the ventilator housing separate from the doors of the housing to be joined to the base member by hinges adjacent to a rectangular side thereof near the outlet ports to make it possible for the ventilator housing to be folded back clear of the base member.

This feature of the invention makes a further contribution as regards simplicity of servicing of the ventilator.

Preferably the centrifugal impellor and the drive motor are supported jointly on a support in the interior of the housing so that they may be inserted and removed from the top side of the housing opposite to the base member. The support, which is preferably in the form of a supporting plate, desireably rests on the ends of four support uprights resembling posts which are mounted on the bottom of one of the housing or base member. The posts are directly supported on the bottom or have damping elements such as pieces of rubber interposed between them and the bottom with the posts being placed parallel to the axis of the impellor and with a radial clearance from the periphery thereof so that, more particularly, they are radially symmetrically arranged about the impellor.

Furthermore the design may be such that the support carrier support uprights extending towards the topside of the housing and preferably axially aligned with the first-mentioned posts, for the cover plate to rest upon with, preferably, a detachable connection between it and the uprights.

These further features of the invention ease the assembly of the ventilator and also facilitate servicing operations, since the separate components are securely kept in place in the interior of the housing so that they are both readily accessible and readily replaced.

In what follows, a more detailed account will be presented of the invention in the form of two working examples as shown in the accompanying drawings.

DETAILED DESCRIPTION OF THE PREFERRED EMBODIMENTS

Figure 3:
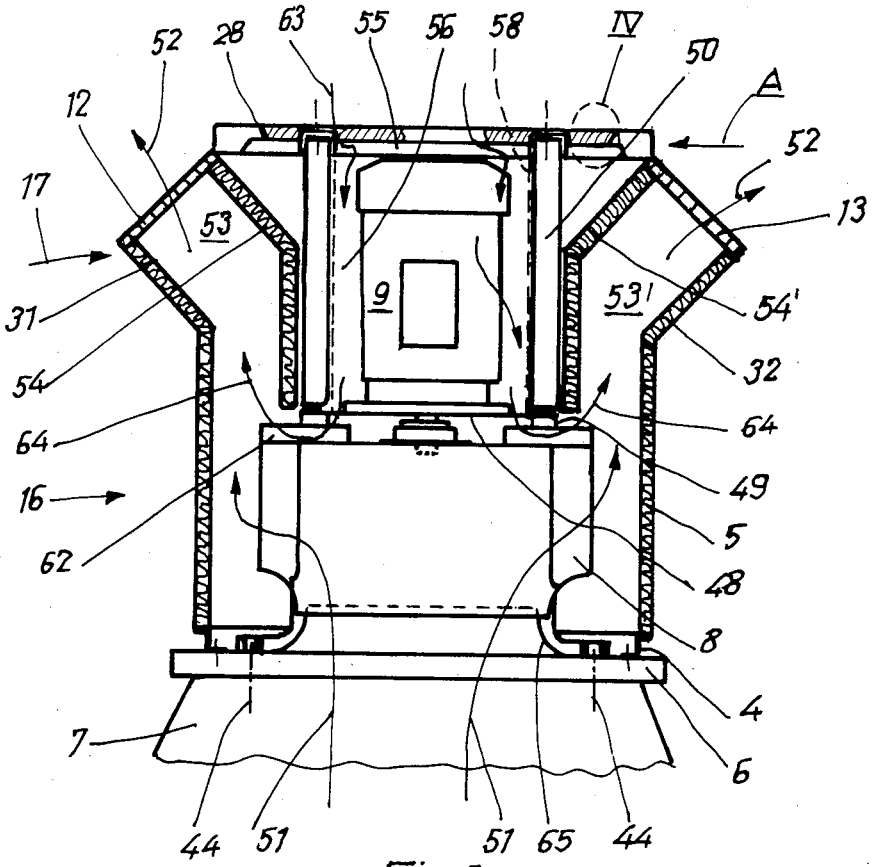
FIG. 3 is a sectional side view of a second embodiment of a roof ventilator in accordance with the invention.

Referring of the drawings it will be seen that the roof ventilator or power fan in accordance with the invention includes a housing 5, whose lower end has a surrounding frame 4 which may be formed by bending the side walls or may prefereably (as in the present case) be separate and be in the form of a section with a web connecting oppositely directed flanges (see also FIG. 3). This frame serves as an intermediate member to attach the housing to a flat rectangular base member 6 more especially by screws. The base member 6 is seated on a mount 7 attached to the outside of a roof or a wall of a room that is to be power-ventilated, i.e. from which air is to be extracted. In cross section, at least the part of the housing 5 adjacent to the base member 6 also has a rectangular as seen in a horizontal plane.

In the interior of the housing 5, a centrifugal impellor 8, shown in broken lines, is mounted on the output shaft of a drive motor 9, which is supported in the interior of the housing in a manner which will be later explained with reference to FIG. 3. The axis 10 of the impellor extends parallel to the longitudinal axis 14 of the housing 5 or (as shown in the present case) coincides therewith and is at a right angle to the plane of the top face of the base member 6. At the bottom next to the mount 7 the housing 5 has an inlet port 15 indicated in broken lines and furthermore the housing 5 has radial outlet means in the form of two outlet ports 12 and 13 directed obliquely upwards though which the air drawn via the inlet port 15 by the centrifugal impellor may be discharged into the surroundings.

Figure 1:
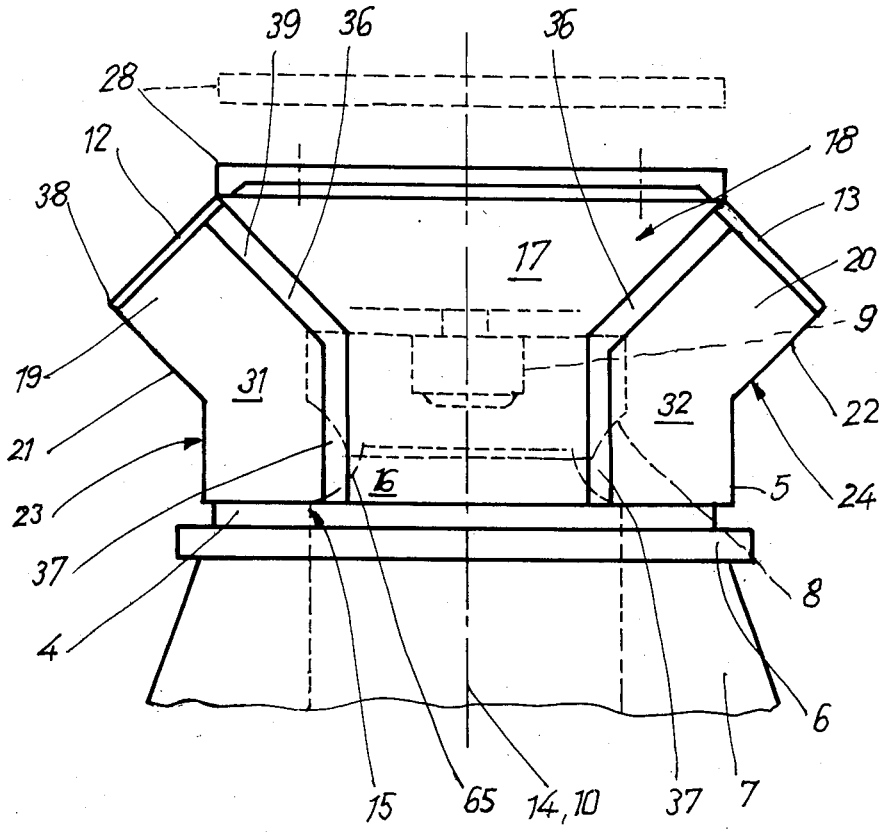
FIG. 1 is a side view of a first form of the roof ventilator in accordance with the invention shown in the closed, operational condition, the cover plate being also shown in broken lines in the position lifted clear of the housing for inspection of the ventilator.

As considered from the point of view of its geometrical appearance and from FIGS. 1 and 3 the housing 5 will be seen to be composed of an upper (17) and a lower (16) part. The first lower part 16, which is adjacent to the frame 4 and the base member 6, is in the form of a rectangular prism so that it has an outline which is rectangular as seen in the longitudinal direction 14. The second upper part 17 is in the form of an irregular hexagonal prism whose hexagonal end walls parallel to the plane of the drawing are two oppositely placed side walls of the housing 5 that are continuations of the walls of the lower part 16. The one wall nearer a person looking at FIG. 1 is referenced 18.

The two opposite sides 21 and 22 of the second part 17 (which are perpendicular to the plane of the drawing) are extended in an outward direction obliquely upwards, that is to say so as to extend away from each other in opposite directions, in the form of wings 19 and 20 when viewed from the perspective of FIG. 1, extends at a right angle in relation to the side wall 18.

The wings 19 and 20 or protrusions may be conceived of as having a triangular outline as viewed in FIG. 1 with approximately equal sides (of which two are inclined and one is vertical) so that the housing 5 may be considered as a rectangular prism on which on two opposite sides there are two projecting prismtic structures or wings 19 and 20 with a triangular vertical section.

In the embodiment of FIG. 1 the height of the first lower housing part 16 below the wings is approximately the same as that of the second upper part 17 with the wings 19 and 20 protruding therefrom. This configuration of the housing is more particularly suitable in the event, as shown, that the drive motor 9 is arranged inside the impellor. On the other hand in the embodiment of the invention illustrated in FIG. 3 the drive motor 9 is above the impellor 8 which is carried on its drive shaft. For this reason the rectangular part 16 then has to be approximately twice as high as the upper part 17 having the wings. The two outlet ports 12 and 13 are in the housing sides 21 and 22 at the top sloping ends of the wings 19 and 20. The top of the housing 5 is shut off by a rectangular cover plate 28.

Figure 2:
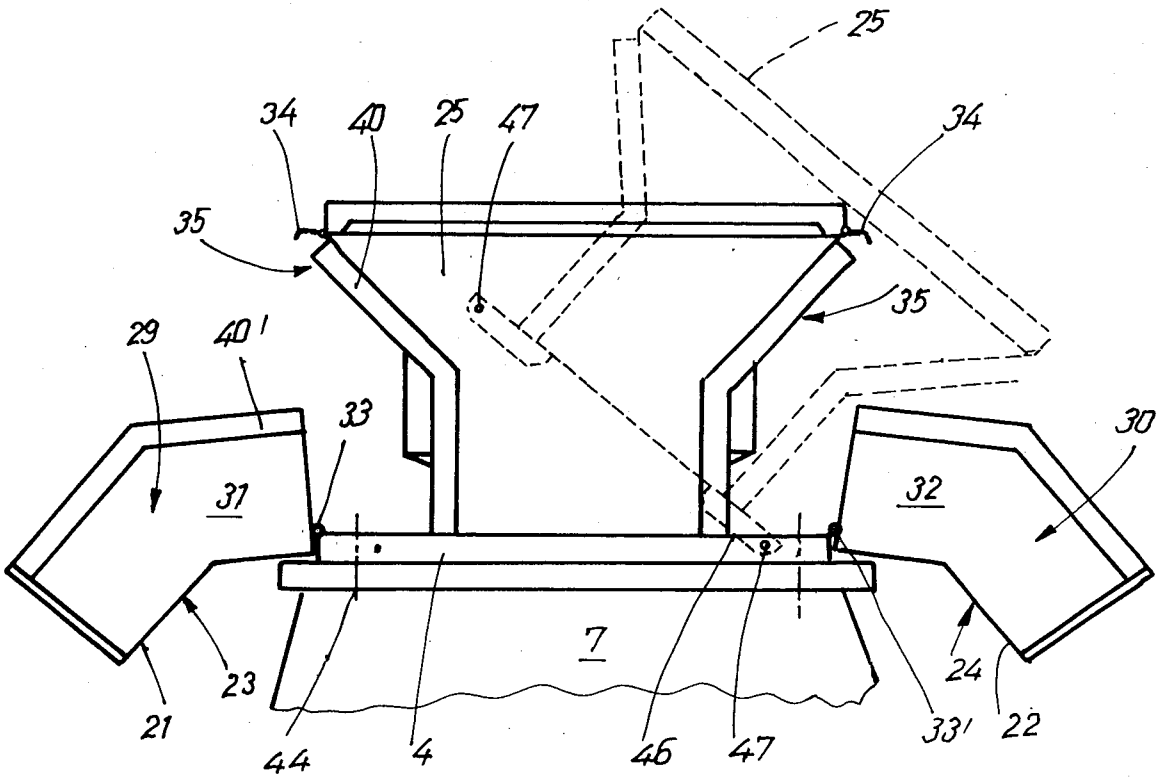
FIG. 2 shows the same ventilator as shown in FIG. 1 opened up for inspection and checking, that is to say with the side walls, which are in the form of doors, hinged open and, shown in broken lines, the base member of the housing being shown in an upwardly pivoted position.

In order to undertake inspection and small servicing operations on the centrifugal impellor 8 or the drive motor 9, for example checking the condition of the impellor, the amount of deposited dirt or the direction of rotation, the housing 5 is able to be split up into three parts, as shown in FIG. 2, that is to say two side sections 31 and 32 and a center part 25 of the housing. Each of the side sections 31 and 32 includes parts of the sides of the lower housing part 16 normal to the plane of FIG. 1, their continuations 21 and 22 and the sections 29 and 30 of the sides of the housing which are parallel to the plane of FIG. 1. This splitting up of the housing involving the radially outward shifting and opening of the side sections 31 and 32 provides useful access to the parts inside the housing, in particular the impellor and the motor. Preferably the housing side sections 31 and 32 with walls 23 and 24 and the outlet ports 12 and 13 are each pivotably hinged about a horizontal axis, for movement away from the rest of the center part 25 of the housing 5 so that there will be no difficulty in reaching the components arranged in the interior of the housing.

In the working examples of the invention shown in the drawings the housing side sections 31 and 32 are each able to be completely removed or (as in the illustrated construction) swung away from the main center part 25 of the housing. In this case the housing 5 may now be imagined as divided into the three separate parts, namely the main center part 25 of the housing and the side sections 31 and 32 of the housing with the outlet ports 12 and 13. Each side sections 31 and 32 comprising a housing side wall 23 and 24, two wall sections 29 and 30 which are opposite to each other and are joined to the edges of the walls 23 and 24. The side sections 31 and 32 accordingly generally have the form of a channel firstly extending upwards parallel to the axis 14 of the power ventilator and then being angled to extend obliquely upwards away from the axis. The opening or open side of the channel is in each case facing towards the interior of the housing and towards the impellor 8 in the operational condition as shown in FIG. 1.

To make possible such opening of the two side sections 31 and 32, the latter may be hinged back away from the center part 25 of the housing about respective pivot axes at the mount 7 and the base member 6 on the housing frame 4. The two pivot pins 33 and 33', each define one of such axes and serve for pivoting of one of the side sections 31 and 32, extending parallel to the associated rectangular side of the rectangular part 16 and also parallel to the surface of the base member 6. They provide a joint with with housing side walls 23 and 24 respectively so that is accordingly possible to open up the housing 5 without much physical effort. The opening not only involves the end sides 21 and 22 of the housing but also in addition, the side wall sections 29 and 30, parallel to the plane of the figure so that for example the impellor may be reached in the direction of view FIG. 1.

Preferably the two side sections 31 and 32 are able to be fully disconnected and removed, such detachment preferably being made possible by so constructing the hinge pins that they may be temporarily disconnected from one of the two parts they respectively connect together.

For latching of the folding side sections 31 and 32 to the center part 25 of the housing in the operational state of the ventilator as illustrated in FIG. 1 it is preferred to have quick-release fasteners or connections 32, preferably (as illustrated here) in the form of hooks, at the positions at which detachment of the side sections 31 and 32 take place. Furthermore at the point 35 of connection between the center part 25 of the housing and the two side sections 31 and 32 there are also, for example, strip seals (not shown) each extending along the edge of the housing which assure an optimum sealing action in the operational conditions of the ventilator at the joins between the three components of the housing.

Since the pivoting side sections 31 and 32 also comprise parts of the side walls parallel to the plane of FIG. 1, it is substantially easier to produce the sides parallel to the plane of FIG. 1 inasfar as the side walls may be conventionally produced by stamping and made for example of sheet metal. Stamping is easier to perform if the sheet metal components have a small area provided by subdivision of the side walls, as compared with cases in which such components have large areas. In the present case there are not problems as regards folding and no need for high priced tooling for the stamping of large components.

The side wall 18 and the wall opposite to it on the other side of the housing which is out of sight in FIG. 1 is joined to the wall sections 29 and 30 as shown in FIGS. 1 and 2 by joints 36, which starting from the edge 4 first each run parallel to the longitudinal axis 14 of the housing at some distance from the outer respective housing side wall 23 and 24 normal to the plane of the figure. The height of this parallel section 37 is somewhat greater than the height of the upright part of the respective side wall 23 and 24, but however it ends short of the level of the outwardly projecting edge 38 of the respective wing 19 or 20. The end of this axis-parallel section 37 is adjoined by a further, upper section 39, directed obliquely outwards and away from the longitudinal axis 14 of the joints. The joint section extends parallel to the oblique, downwardly turned face of the respective wing 19 or 20 to end at the upper external edge part of the top side of the housing. The wall sections 29 and 30 accordingly have the form of two limbs with an obtuse angle therebetween as seen in the side view of FIGS. 1 and 2.

Parts of the seals noted above extend along the joints 36

The edge parts forming the joints 36, at the center part 25 of the housing and of the side sections 31 and 32 are arranged so that they are parallel to each other (as marked 40 and 40' in FIG. 2) and are overlapped in the operational state as shown in FIG. 1; this means that in operation the components of the housing are securely held together and the housing has a high degree of stiffness.

The particular configuration of the side sections 31 and 32 described offers the advantage, on the one hand, that the housing 5 may be opened to expose a large part of the centrifugal impellor arranged adjacent to the base plate or member 6 and on the other hand, adjacent to the top part of the cover plate the housing 5 will in no way obstruct the pivotable motion. As seen looking towards the side wall 18, the center part of the housing has the form of a rectangle with a breadth less than the breadth of the overall housing 5, and on which an upwardly widening trapezoid is placed.

One advantage of the roof ventilator in accordance with the invention is that the base plate 6 may have an outline generally identical to that of the edge 4 and of the adjoining part 16, since it is possible to align holes in the housing 5, base member 6, and side sections 31 and 32 to accept fastening means such as screws or the like. On hinging back the side sections 31 and 32 these aligned holes will be readily accessible for assembly or disassembly of the roof ventilator; screw connections for this purpose are indicated in FIG. 2 at 44.

In order to make the centrifugal impellor 8 readily accessible from below for servicing the ventilator housing, its center part 25 is pivotally joined at one of the sides of the rectangle having the outlet ports to the base member 6 so that upward hinging is possible. For this purpose the center part 25 of the housing has hinge members 46 fixedly mounted to its lower side and on the other hand pivotably connected to the edge 4. It is convenient if the pivoting hinge pins 47 are arranged adjacent to one of the side sections 31 and 32, such members preferably extending normal to the respectively adjacent pivot pin 33 and 33' of the side sections 31 and 32 so that the center part of the housing may be selectively swung upwards to the one or the other side. (The center part of the housing is shown in FIG. 2 in broken lines in its upwardly pivoted position).

It is an advantage if the drive motor 9 together with the centrifugal impellor may be pivoted upwards with the center part 25 of the housing.

A further simplification of the servicing of the roof ventilator in accordance with the invention is possible if, as in FIG. 3, both the centrifugal impellor 8 and also the drive motor 9 may be inserted and removed via the top side of the housing and are supported jointly on a support 48 in the interior of the housing. As shown in FIG. 3 there are four column-like uprights 49 referred to as posts each having one end attached to the base plate 6 so as to extend upwards parallel to the longitudinal direction 14. These posts extend past the centrifugal impellor 8 in the axial direction upwards and are arranged radially symmetrically outside the centrifugal impellor 8. The posts mount via shock absorbing elements a support 48 which is in the form of a plate extending over the impellor 8. The support 48 in turn mounts the drive motor 9. The output member of the drive motor 9 is connected with the centrifugal impellor 8.

In the embodiment of the invention to be seen in FIG. 3 the drive motor 9 (which is arranged above the impellor) is mounted over the support 48, whereas in the example of FIG. 1 the drive motor 9 is placed under, and suspended from the corresponding support (not separately referenced) and within the impellor.

On the support 48 there are further upwardly extending uprights 50 whose number is equal to the number of the uprights 49 so as to form axial extensions thereof. The uprights 50 project upwardly slightly past the top side of the housing 5 and carry the removable cover plate 28 shutting off the top of the housing. The cover plate 28 is preferably screwed to the top ends of the uprights 50 so that it may be disconnected from them.

When servicing operations are due it is now a simple matter to rapidly gain access to and remove the drive motor 9 and its centrifugal impellor 8. It is only necessary to remove the cover plate 28 with the uprights 50 (see position of cover plate shown in FIG. 1) and pivot open the two side sections 31 and 32, if necessary, in order to make it possible for the motor 9 and the impellor to be removed in the form of a modular unit. It is also possible to remove the entire unit composed of the cover plate 28, the uprights 50, the support carrier, the drive motor 9 and the impellor after simply pivoting the side sections 31 and 32 into their open positions and then undoing the connections between the uprights 49 and the base plate 6.

Figure 4:
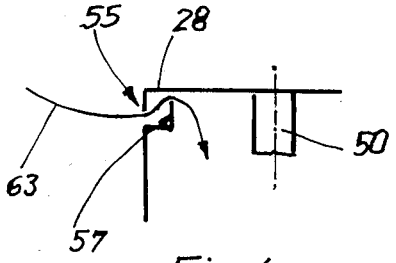
FIG. 4 schematically shows a detail in section taken through the cover plate in the vicinity of one of its air passage slots in a part marked IV in FIG. 3 and looking in the direction of the arrow A therein.

During operation of the power roof ventilator the air current propelled by the impellor 8 is drawn inwards through the inlet port 15 moves in the direction indicated by the arrows 51 and is expelled as indicated by arrows 52 through the outlet ports 12 and 13. After leaving the impellor 8 the current is firstly propelled in two ducts 53 and 53' leading to respective outlet ports 12 and 13. These ports are defined on three of their sides by the inner faces of the wall sections 29 and 30, respectively, and of the walls 23 and 24, and the fourth wall 54 and 54' is located in the interior of the housing 5 and extends from a point at some distance above the centrifugal impellor 8 generally along the respective joint 36. The walls 54 and 54' are parts of the side sections 31 and 32 and may be pivoted therewith away from the rest of the structure. For damping sound, the wall sections defining the ducts may be made in two layers and filled with acoustic insulating material therebetween (see FIG. 3). Alternatively they may be lined with sound insulating material. In order to ensure efficient cooling of the motor 9, and more particularly the motor 9 mounted outside the impellor which does not have the air impinging onto it, even when the power ventilator is run under heavy duty conditions, there are ventilation gaps 55 in the cover plate 28 in order to supply cooling air into the motor 9 space 56 around the motor 9. This is particularly advisable if the drive motor 9 is encapsulated, as indicated in broken lines at 58 in FIG. 3, for quieter running. The air ports or gaps 55 may be provided directly in the cover plate 28, but it is preferred, as indicated diagrammatically in FIG. 4 for them to be formed by spaces between the topside 57 and the cover plate 28. In the latter case it is best for the uprights 50 to ensure the desired height of the gaps and it is possible to employ a cover plate with a very simple design, as for example a piece of sheet metal with its edges bent downwards as sides.

In order to ensure a particularly intense form of motor cooling it will be seen from FIG. 3 that the motor space 56 is additionally connected with the outlet ports 12 and 13 with the centrifugal impellor 8 therebetween. If desired the support 48 may have ports (not shown) therein for this purpose. The current of cooling air is then produced by the impellor itself which for this purpose has straight or curved blades 62 extending radially outwards on its axial side facing the cover plate 28. The current of cooling air will move as indicated by the arrows 64 through the ports when the impellor rotates and then will follow the arrows 52 through the outlet ports back into the surroundings. At 65 there is an input nozzle leading to the centrifugal impellor 8.

It is to be further added that the connection part between the side sections 31 and 32 and the center part of the housing may be made deeper in the form of a groove along the joints 36 if desired so that the overall arrangement will have a pleasing exterior.

With respect to the center part 25 of the housing (see FIG. 2) able to be folded upwards, it is to be noted that it may obviously be mounted on only one pivot pin (hinge member 47) if desired so that it will be swung upwards on one side. On the opposite side it is then possible to have a latch to lock the center part of the housing in the untilted position.

We claim:

1. A power extractor ventilator for mounting on the outside of a building, comprising:

a centrifugal impellor and a driving motor therefor constituting a motor-impellor unit, a housing containing said unit, a plate-like, flat base member joined to said housing, said housing being rectangular where it is joined to said base member, said housing having an inlet port at said base member and being adapted to discharge air in a radial direction away from the vicinity of said ventilator from two rectangular oppostie sides thereof through two outlet ports, and having a first pair of first opposite walls extending away from said base member and a second pair of second opposite walls extending away from said base member, such walls representing the sides of a rectangle placed around said motor-impellor unit, said housing furthermore including readily opening side sections with said outlet ports therein at two said opposite sides and a center section therebetween, each of said side sections including one of said first walls and parts of said second walls axially aligned and adjacent to said first walls so that each of said side sections is in the form of a channel extending generally in the direction of the axis of the said unit and opening towards same, said side sections including said first housing walls pivotally mounted about axes that are at said base member to said base member for pivoting motion between said closed operational state of said ventilator and an open position.

2. The ventilator as claimed in claim 1 wherein said pivot axes at said base member are parallel to sides of said base member which are adjacent to and aligned with ends of said first walls at outer limits of said housing.

3. The ventilator as claimed in claim 1 wherein said side sections are detachably joined to portions of said second walls separate from said side sections.

4. The ventilator as claimed in claim 3 comprising strips of sealing material for forming joints between said base member and said side sections.

5. The ventilator as claimed in claim 1 wherein said center section is pivotably mounted to said base member at an axis adjacent to one of said side sections.

6. The ventilator as claimed in claim 1 comprising a carrier within said housing and carrying said motor and said centrifugal impellor, said housing being so designed that said carrier with said motor and said centrifugal impellor attached thereto may be removed from and inserted into housing from an end of said housing remote from said inlet port therein.

7. The ventilator as claimed in claim 6 comprising four support columns extending away from said base member towards said carrier parallel to the axis of said centrifugal impellor and radially clear of said centrifugal impellor and being joined with said carrier at ends of said columns remote from said base member.

8. The ventilator as claimed in claim 7 comprising vibration damping elements forming connections between said carrier, which is in the form of a plate, and said column ends remote from said base member.

9. The ventilator as claimed in claim 8 comprising a cover plate and supports extending from said carrier to said cover plate to support same at an end of said housing opposite to said base member, said supports being axially aligned with said columns.

10. The ventilator as claimed in claim 1 further comprising a cover plate at a top end of said housing opposite to said base member and having openings therein for the ventilation of a space surrounding said motor.

11. The ventilator as claimed in claim 1 further comprising a cover plate at a top end of said housing opposite to said base member and mounted so as to leave a air gap clearance between it and adjacent parts of said housing for the ventilation of a space surrounding said motor.

12. The ventilator as claimed in claim 11 wherein said centrifugal impellor comprises a disk with first blades mounted on one side of it facing said base member and second blades on the opposite side of said disk, said second blades serving to propel air through said space and out through said gap.

13. The ventilator as claimed in claim 12 wherein said motor is encapsulated.

14. The ventilator as claimed in claim 1 wherein as seen looking towards one of the said second sides said housing is to be considered as a combination of a rectangular prism adjacent to said base member and a hexagonal prism having first two opposite parallel sides of which one is contiguous with said rectangular prism and secondly two pairs of protruding sides forming protrusions on said housing, said side sections being in the form of channels each with a straight part extending from said base member as far as a respective one of said protrusions and a second part at an oblique angle to said straight part and constituting at least part of said protrusion.

15. The ventilator as claimed in claim 1 wherein when said second side walls, exclusive of said side sections, are considered as combined geometrical figures each comprising a rectangle adjacent to said base and a trapezoid of which one shorter parallel side adjoins said adjacent rectangle and the other, longer parallel side is remote therefrom.

* * * * *